US009315928B2

(12) United States Patent
Cheng

(10) Patent No.: US 9,315,928 B2
(45) Date of Patent: Apr. 19, 2016

(54) ROUND BRAID AND MANUFACTURING METHOD THEREOF

(71) Applicant: TAIWAN PAIHO LIMITED, Chang Hwa Hsien (TW)

(72) Inventor: Sen-Mei Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 321 days.

(21) Appl. No.: 14/056,963

(22) Filed: Oct. 18, 2013

(65) Prior Publication Data

US 2014/0305289 A1 Oct. 16, 2014

(30) Foreign Application Priority Data

Apr. 15, 2013 (CN) ..... 2013 1 0129486
Apr. 15, 2013 (CN) ..... 2013 2 0188067 U

(51) Int. Cl.
*D04C 1/12* (2006.01)

(52) U.S. Cl.
CPC ..... *D04C 1/12* (2013.01)

(58) Field of Classification Search
CPC ..... D04C 1/12
USPC ..... D2/978
See application file for complete search history.

(56) References Cited

U.S. PATENT DOCUMENTS 4,100,835 A * 7/1978 Kozlowski ..... F16J 15/22 87/1
5,272,796 A * 12/1993 Nichols ..... A43C 9/00 24/712
5,673,546 A * 10/1997 Abraham ..... A43C 9/00 24/713
D442,361 S * 5/2001 Chen ..... D2/978
6,283,004 B1 * 9/2001 Tseng ..... D07B 5/005 57/230

FOREIGN PATENT DOCUMENTS

CN 2626288 Y 7/2004
CN 1938478 A 3/2007

* cited by examiner

*Primary Examiner* — Shaun R Hurley
(74) *Attorney, Agent, or Firm* — CKC & Partners Co., Ltd.

(57) ABSTRACT

A round braid includes a plurality of warp strands and a binding strand. Each of the warp strands has at least one thread. The binding strand has at least one thread. The binding strand binds a part of the warp strands along an extending direction of the warp strands so as to form a plurality of exposing segments and a plurality of bulging segments on an outer surface of the round braid. The exposing segments are exposing parts of the binding strand and the bulging segments are uncovered parts of the warp strands. The exposing segments and the bulging segments are disposed staggeredly.

6 Claims, 9 Drawing Sheets

ROUND BRAID AND MANUFACTURING METHOD THEREOF

RELATED APPLICATIONS

The application claims priority to China Application Serial Number 201310129486.4 filed Apr. 15, 2013, and China Application Serial Number 2013201880673 filed Apr. 15, 2013, which are herein incorporated by references.

BACKGROUND

1. Technical Field

The present disclosure relates to a braid and a manufacturing method thereof. More particularly, the present disclosure relates to a round braid formed by using a binding strand to bind warp strands and a manufacturing method thereof.

2. Description of Related Art

A conventional shoelace can be sorted into a round shoelace or a flat shoelace according to a shape thereof. The round shoelace indicates a shoelace having a round cross section, and the cross-sectional area thereof is substantially fixed. A conventional round shoelace has a core and a knitting sheath, wherein the core is enclosed within the knitting sheath. The core is the main body of the round shoelace and thus provides the round shoelace a desired volume and mass. Furthermore, the core provides the round shoelace desired physical properties such as strength and elasticity.

The knitting sheath is made of a plurality of threads. The threads are knitted via a circular knitting machine so as to form the knitting sheath. The knitting sheath provides the round shoelace a desired aesthetic value.

However, the aforementioned round shoelace has disadvantages as follows. First, the round shoelace has a fixed cross-sectional area and an arc-shaped outer surface, so that a friction coefficient of the outer surface is poor. Although the knitting sheath has a knitting texture, the rugged degree provided by the knitting texture is pretty low due to the manufacturing machine (i.e. the circular knitting machine) and method. As a result, the knitting sheath fails to increase the friction coefficient effectively. When the kind of round shoelace is used, the round shoelace slips in lace holes due to the poor friction coefficient. Furthermore, the round shoelace is too slippery to form a solid knot, so that the knot is loosened easily and the foot of the wearer cannot be fixed securely in the shoe. Second, the core and the knitting sheath are usually made of different kinds of threads for providing different properties, so that at least two production lines are needed for manufacturing the different kinds of threads. Moreover, when the knitting sheath is made of at least two kinds of threads, the more kinds of the threads are used, the more production lines are needed. Third, the manufacturing process includes at least three steps, which are producing different kinds of threads, forming the core and knitting sheath respectively, and enclosing the core within the knitting sheath, so that the manufacturing process is complicated and cumbersome.

Therefore, the manufacturer is in need of a round shoelace having a large friction coefficient so as to provide a desired fixed effect. The manufacturer also in need of a round shoelace having a simple manufacturing process so as to reduce the production cost and enhance the production efficiency.

SUMMARY

According to one aspect of the present disclosure, a round braid includes a plurality of warp strands and a binding strand. Each of the warp strands has at least one thread. The binding strand has at least one thread. The binding strand binds a part of the warp strands along an extending direction of the warp strands so as to form a plurality of exposing segments and a plurality of bulging segments on an outer surface of the round braid. The exposing segments are exposing parts of the binding strand and the bulging segments are uncovered parts of the warp strands. The exposing segments and the bulging segments are disposed staggeredly.

According to another aspect of the present disclosure, a manufacturing method of a round braid includes steps as follows. A plurality of warp strands are provided, wherein each of the warp strands has at least one thread. A binding strand having at least one thread is provided. The warp strands are bound, wherein the binding strand binds a part of the warp strands along an extending direction of the warp strands so as to form a plurality of exposing segments and a plurality of bulging segments on an outer surface of the round braid, the exposing segments are exposing parts of the binding strand, the bulging segments are uncovered parts of the warp strands, and the exposing segments and the bulging segments are disposed staggeredly.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
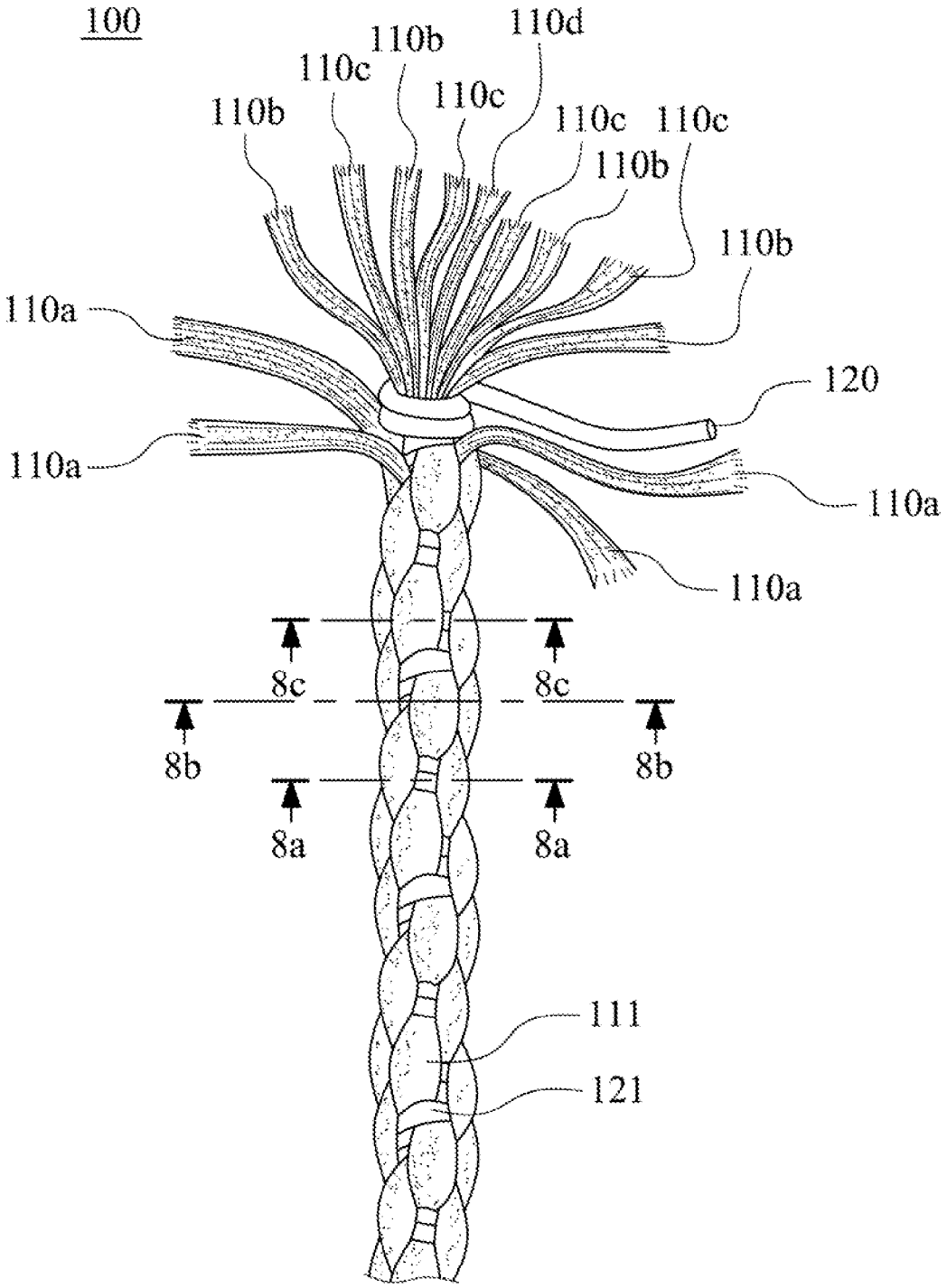
FIG. 1 is a perspective view of a round braid according to the 1st embodiment of the present disclosure.

FIG. 1 is a perspective view of a round braid 100 according to the 1st embodiment of the present disclosure. In FIG. 1, the round braid 100 includes four warp strands 110*a*, four warp strands 110*b*, four warp strands 110*c*, a warp strand 110*d* and a binding strand 120. Hereinafter the warp strands 110*a*-110*d* refer to the four warp strands 110*a*, the four warp strands 110*b*, the four warp strands 110*c* and the warp strand 110*d*. Each of the warp strands 110*a*-110*d* has a plurality of threads, and the threads are made of the same material. The warp strands 110*a*-110*d* are substantially arranged in parallel. In other words, an extending direction of the warp strands 110*a* is substantially the same as that of the warp strands 110*b*, the warp strands 110*c* and the warp strand 110*d*. The binding strand 120 has only one thread. The material of the thread of the binding strand 120 can be the same as that of the threads of the warp strands 110*a*-110*d*. The binding strand 120 binds a part of the warp strands 110*a*-110*d* along the extending direction of the warp strands 110*a*-110*d* so as to form a plurality of exposing segments 121 and a plurality of bulging segments 111 on an outer surface of the round braid 100. The exposing segments 121 are exposing parts of the binding strand 120. More specifically, the exposing segments 121 are the parts of the binding strand 120 which are not covered by the warp strands 110*a*-110*d* so as to expose on the outer surface of the round braid 100. The bulging segments 111 are uncovered parts of the warp strands 110*a*-110*d*. More specifically, the bulging segments 111 are the parts of the warp strands 110*a*-110*d* which are not covered by the binding strand 120 so as to bulge on the outer surface of the round braid 100. The exposing segments 121 and the bulging segments 111 are disposed staggeredly. As a result, the outer surface of the round braid 100 is rugged for providing an anti-slip function and a fixed effect. Therefore, the round braid 100 is suitable for utilizing as shoelaces or drawstrings for fastening shoes, bags or clothes.

Figure 7:
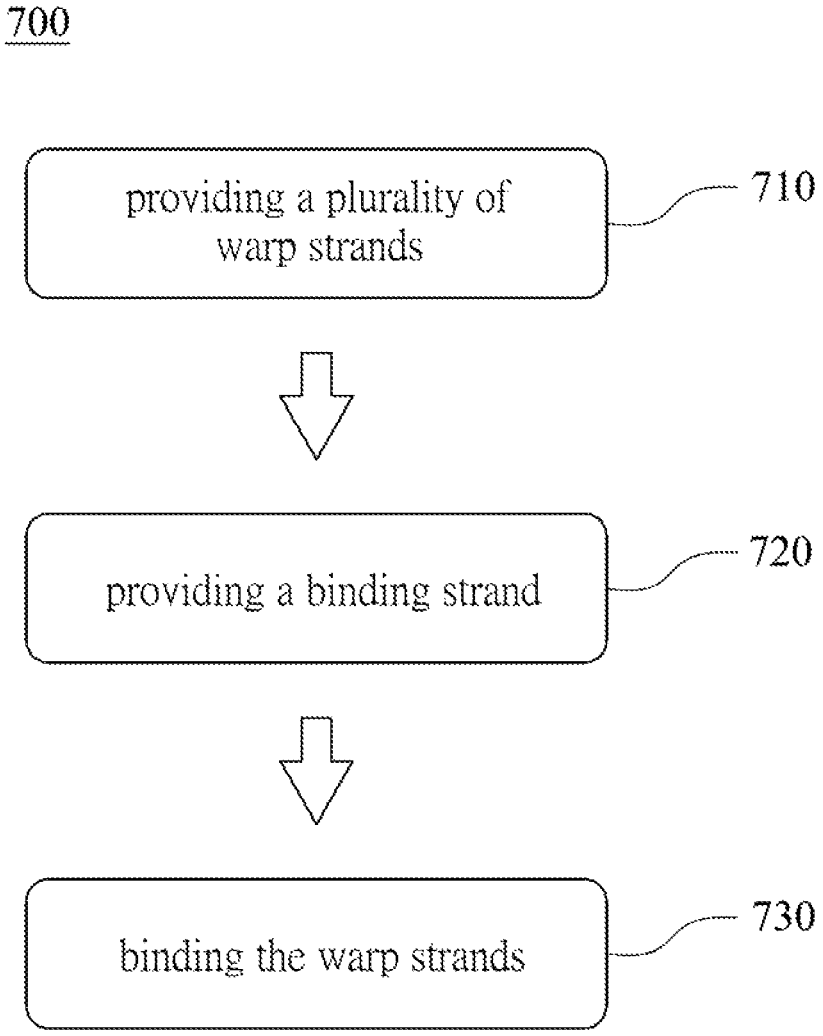
FIG. 7 is a flow diagram of a manufacturing method of a round braid according to further another embodiment of the present disclosure.

FIG. 7 is a flow diagram of a manufacturing method 700 of a round braid according to another embodiment of the present disclosure. The manufacturing method 700 includes steps as follows. In Step 710, a plurality of warp strands are provided, and each of the warp strands has at least one thread. In Step 720, a binding strand is provided, and the binding strand has at least one thread. In Step 730, the warp strands are bound, wherein the binding strand binds a part of the warp strands along an extending direction of the warp strands so as to form a plurality of exposing segments and a plurality of bulging segments on an outer surface of the round braid. The exposing segments are exposing parts of the binding strand, and the bulging segments are uncovered parts of the warp strands. The exposing segments and the bulging segments are disposed staggeredly. The order of Step 710 and Step 720 can be reversed.

The following will take the round braid 100 shown in FIG. 1 as an example for illustrating the manufacturing method 700 more specifically. Please refer to FIG. 1 and FIG. 7. In Step 710, the warp strands 110*a*-110*d* are provided, and each of the warp strands 110*a*-110*d* has a plurality of threads. In Step 720, the binding strand 120 is provided, and the binding strand 120 has a thread. In Step 730, the warp strands 110*a*-110*d* are bound, wherein the binding strand 120 binds a part of the warp strands 110*a*-110*d* along the extending direction of the warp strands 110*a*-110*d* so as to form the plurality of exposing segments 121 and the plurality of bulging segments 111 on the outer surface of the round braid 100. The exposing segments 121 are the exposing parts of the binding strand 120, and the bulging segments 111 are the uncovered parts of the warp strands 110*a*-110*d*. The exposing segments 121 and the bulging segments 111 are disposed staggeredly.

Figure 8A:
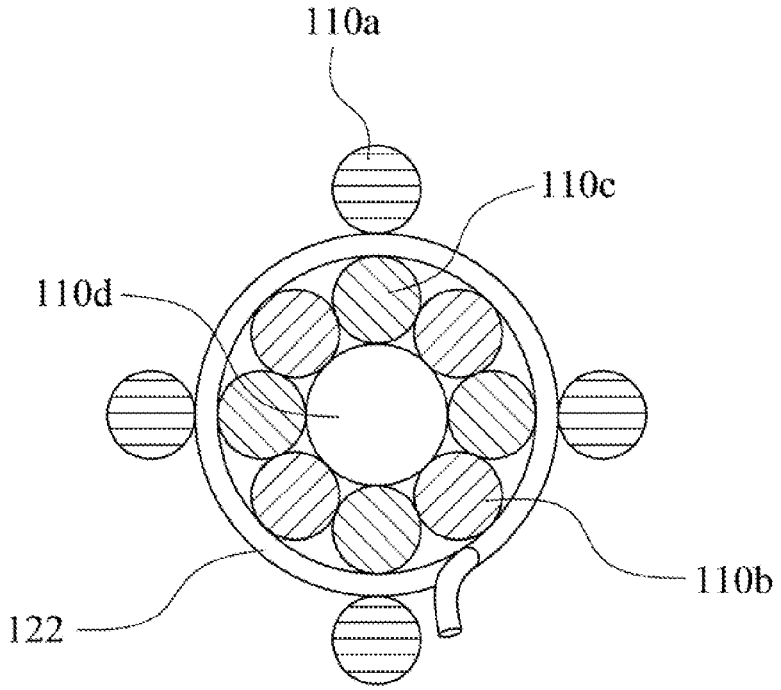
FIG. 8A is a cross-sectional schematic view of the round braid along line 8*a*-8*a* shown in FIG. 1.
Figure 8B:
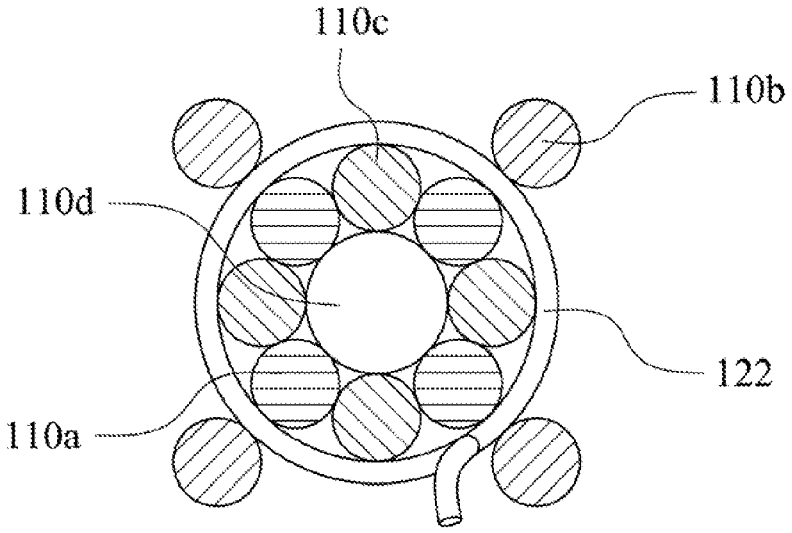
FIG. 8B is a cross-sectional schematic view of the round braid along line 8*b*-8*b* shown in FIG. 1.
Figure 8C:
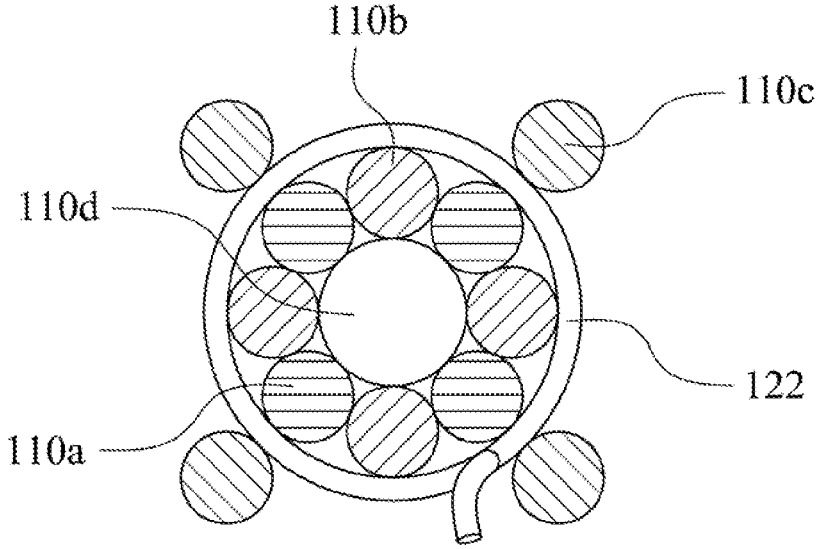
FIG. 8C is a cross-sectional schematic view of the round braid along line 8*c*-8*c* shown in FIG. 1.

Please refer to FIG. 1, FIG. 8A, FIG. 8B and FIG. 8C. FIG. 8A is a cross-sectional schematic view of the round braid 100 along line 8*a*-8*a* shown in FIG. 1, FIG. 8B is a cross-sectional schematic view of the round braid 100 along line 8*b*-8*b* shown in FIG. 1. FIG. 8C is a cross-sectional schematic view of the round braid 100 along line 8*c*-8*c* shown in FIG. 1. When manufacture the round braid 100, the warp strands are categorized into four groups which are the four warp strands 110*a*, the four warp strands 110*b*, the four warp strands 110*c*, and the warp strand 110*d* respectively. The warp strands 110*a*-110*d* are arranged in parallel, wherein the warp strand 110*d* is disposed at a center of the round braid 100, and the warp strands 110*a*, the warp strands 110*b*, and the warp strands 110*c* are staggeredly disposed around the warp strand 110*d*. The order that the binding strand 120 binds the warp strands 110*a*-110*d* is shown in FIG. 8A to FIG. 8C. First, as shown in FIG. 8A, the binding strand 120 forms a weft-wise loop 122, then the weft-wise loop 122 is strained so as to bind the warp strands 110*b*, the warp strands 110*c* and the warp strand 110*d* with the weft-wise loop 122. Repeat the foregoing step three times, that is, the binding strand 120 binds the warp strands 110*b*, the warp strands 110*c* and the warp strand 110*d* with three weft-wise loops 122. The number of the weft-wise loop 122 for binding the warp strands 110*b*, the warp strands 110*c* and the warp strand 110*d* can be adjusted according to practical demand.

Second, as shown in FIG. 8B, pull the warp strands 110*b* away from the center of the round braid 100. The binding strand 120 forms another weft-wise loop 122, then the weft-wise loop 122 is strained so as to bind the warp strands 110*a*, the warp strands 110*c* and the warp strand 110*d* with the weft-wise loop 122. Repeat the foregoing step three times, that is, the binding strand 120 binds the warp strands 110*a*, the warp strands 110*c* and the warp strand 110*d* with three weft-wise loops 122.

Third, as shown in FIG. 8C, pull the warp strands 110*c* away from the center of the round braid 100. The binding strand 120 forms another weft-wise loop 122, then the weft-wise loop 122 is strained so as to bind the warp strands 110*a*, the warp strands 110*b* and the warp strand 110*d* with the weft-wise loop 122. Repeat the foregoing step three times, that is, the binding strand 120 binds the warp strands 110*a*, the warp strands 110*b* and the warp strand 110*d* with three weft-wise loops 122. The round braid 100 is formed by repeating the aforementioned steps shown in FIG. 8A to FIG. 8C.

As mentioned above, the binding strand 120 binds a part of the warp strands 110*a*-110*d* each time, and the binding strand 120 binds the warp strands 110*a*-110*d* along the extending direction of the warp strands 110*a*-110*d*. As a result, the plurality of exposing segments 121 and the plurality of bulging segments 111 are formed on the outer surface of the round braid 100, and the exposing segments 121 and the bulging segments 111 are disposed staggeredly.

When manufacture the round braid 100, the way which the binding strand 120 binds the warp strands 110*a*-110*d* can be changed, so that the arrangement of the exposing segments 121 and the bulging segments 111 on the outer surface of the round braid 100 can be changed accordingly. Furthermore, the tightening degree between the binding strand 120 and the warp strands 110*a*-110*d* can be changed, so that the rugged degree on the outer surface of the round braid 100 can be changed accordingly. Therefore, a variety of round braid 100 can be obtained for providing a desired anti-slip function and/or a desired aesthetic value.

Figure 9:
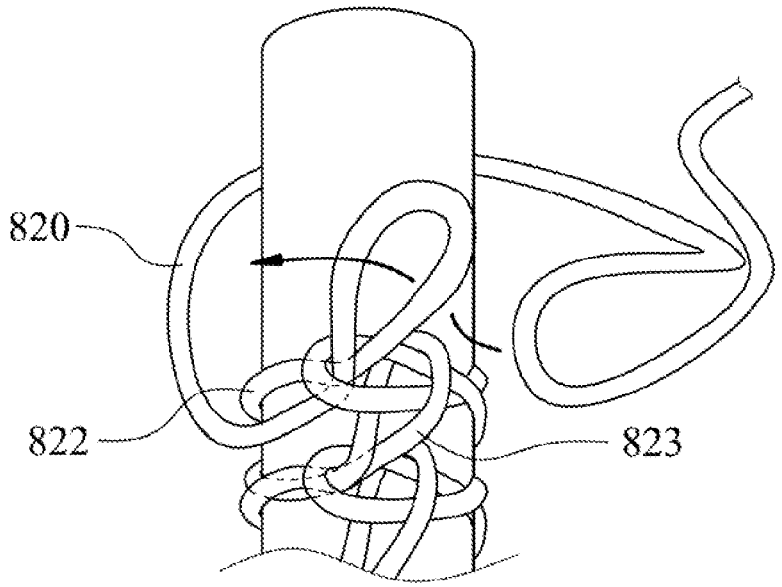
FIG. 9 is a schematic view illustrating the weft-wise loops of a binding strand of a round braid according to yet another embodiment of the present disclosure.

FIG. 9 is a schematic view illustrating the weft-wise loops 822 of a binding strand 820 of a round braid according to another embodiment of the present disclosure. FIG. 9 is for illustrating the hook relationship between the weft-wise loops 822, so that the other details of the round braid are not depicted FIG. 9. When the binding strand 820 binds the warp strands, a plurality of weft-wise loops 822 are formed along the extending direction of the warp strands, and the binding strand 820 binds the warp strands with the weft-wise loops 822. In the embodiment, each of the weft-wise loops 822 has a hook portion 823. Each of the weft-wise loops 822 threads through the hook portion 823 of the adjacent weft-wise loop 822, and the weft-wise loops 822 hook with each other thereby. Making the weft-wise loops 822 hook with each other is a conventional technology, and the details thereof will not be described herein.

Figure 2:
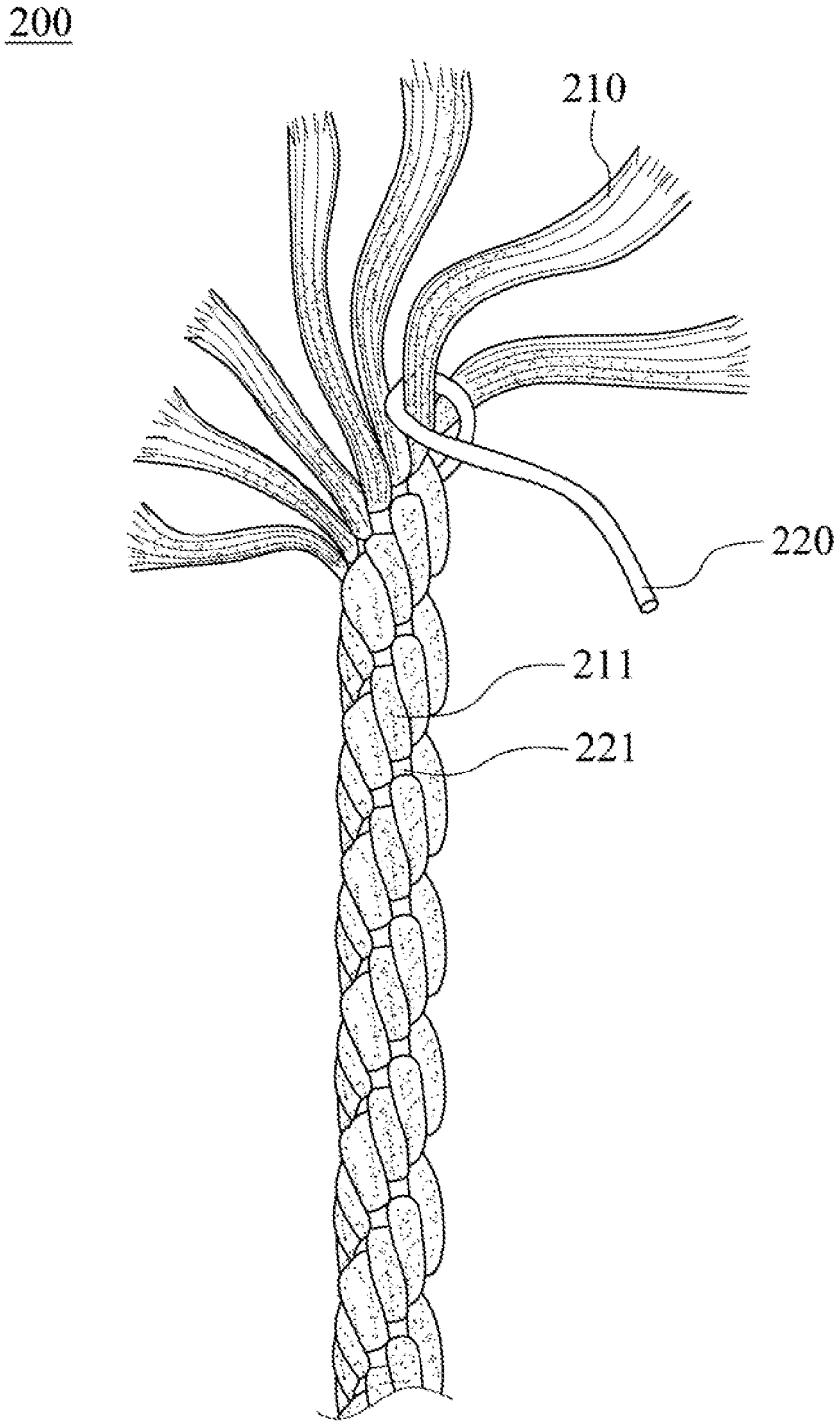
FIG. 2 is a perspective view of a round braid according to the 2nd embodiment of the present disclosure.

FIG. 2 is a perspective view of a round braid 200 according to the 2nd embodiment of the present disclosure. In FIG. 2, the round braid 200 is formed in a spiral shape, wherein exposing segments 221 of a binding strand 220 and bulging segments 211 of warp strands 210 are disposed staggeredly. The way which the binding strand 220 binds the warp strands 210 is different from that of the round braid 100 shown in FIG. 1. In the embodiment, the exposing segments 221 of the binding strand 220 change locations thereof along an extending direction of the warp strands 210, so that the exposing segments 221 are arranged in a spiral path.

Figure 3:
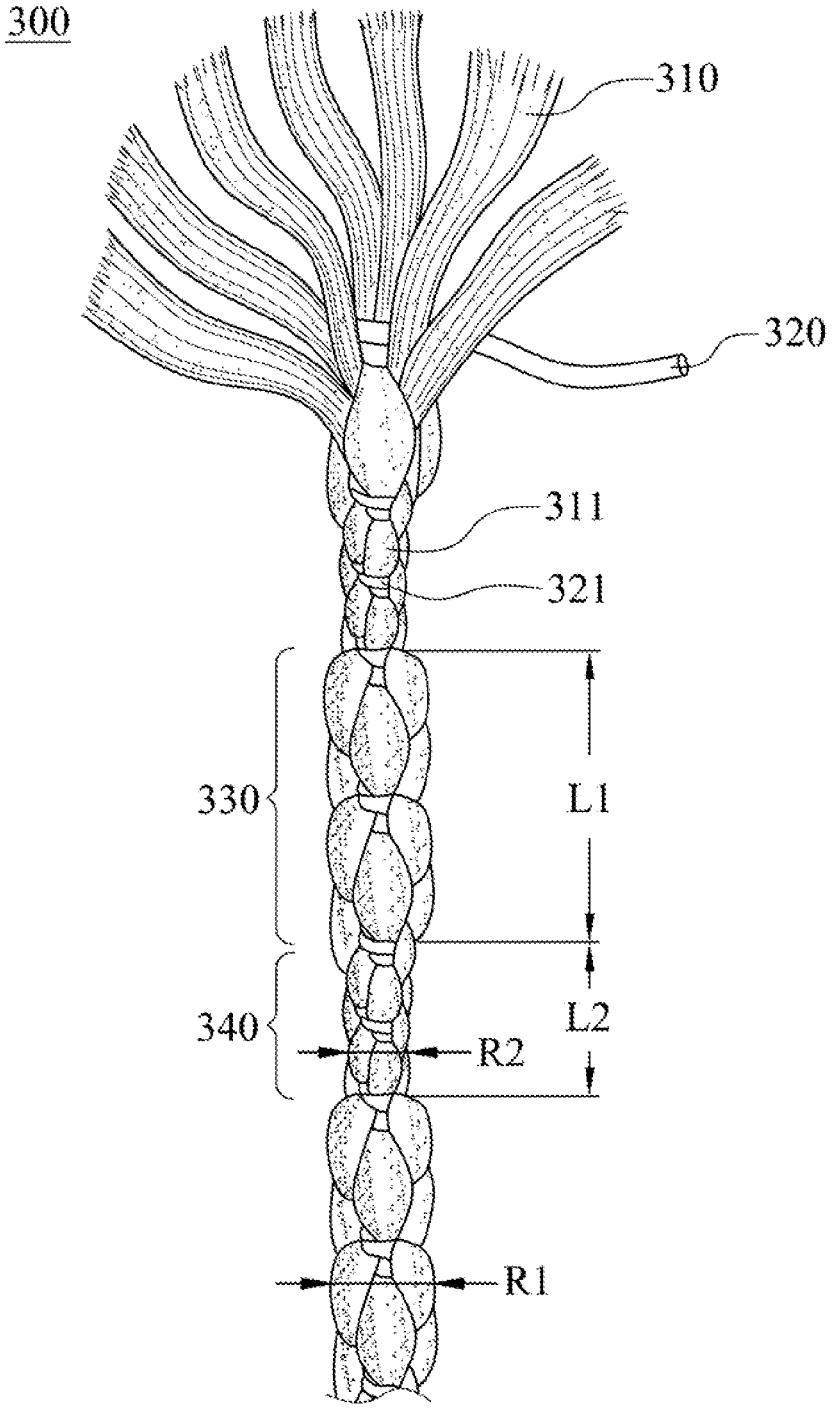
FIG. 3 is a perspective view of a round braid according to the 3rd embodiment of the present disclosure.

FIG. 3 is a perspective view of a round braid 300 according to the 3rd embodiment of the present disclosure. In FIG. 3, exposing segments 321 of a binding strand 320 and bulging segments 311 of warp strands 310 are disposed staggeredly. Moreover, the round braid 300 has a plurality of large diameter segments 330 and a plurality of narrow neck segments 340, wherein the large diameter segments 330 and the narrow neck segments 340 are disposed staggeredly along an extending direction of the warp strands 310. A diameter R1 of the large diameter segment 330 is larger than a diameter R2 of the narrow neck segments 340, and a length L1 of the large diameter segment 330 is longer than a length L2 of the narrow neck segments 340. Therefore, a further anti-slip function of the round braid 300 is provided.

Figure 4:
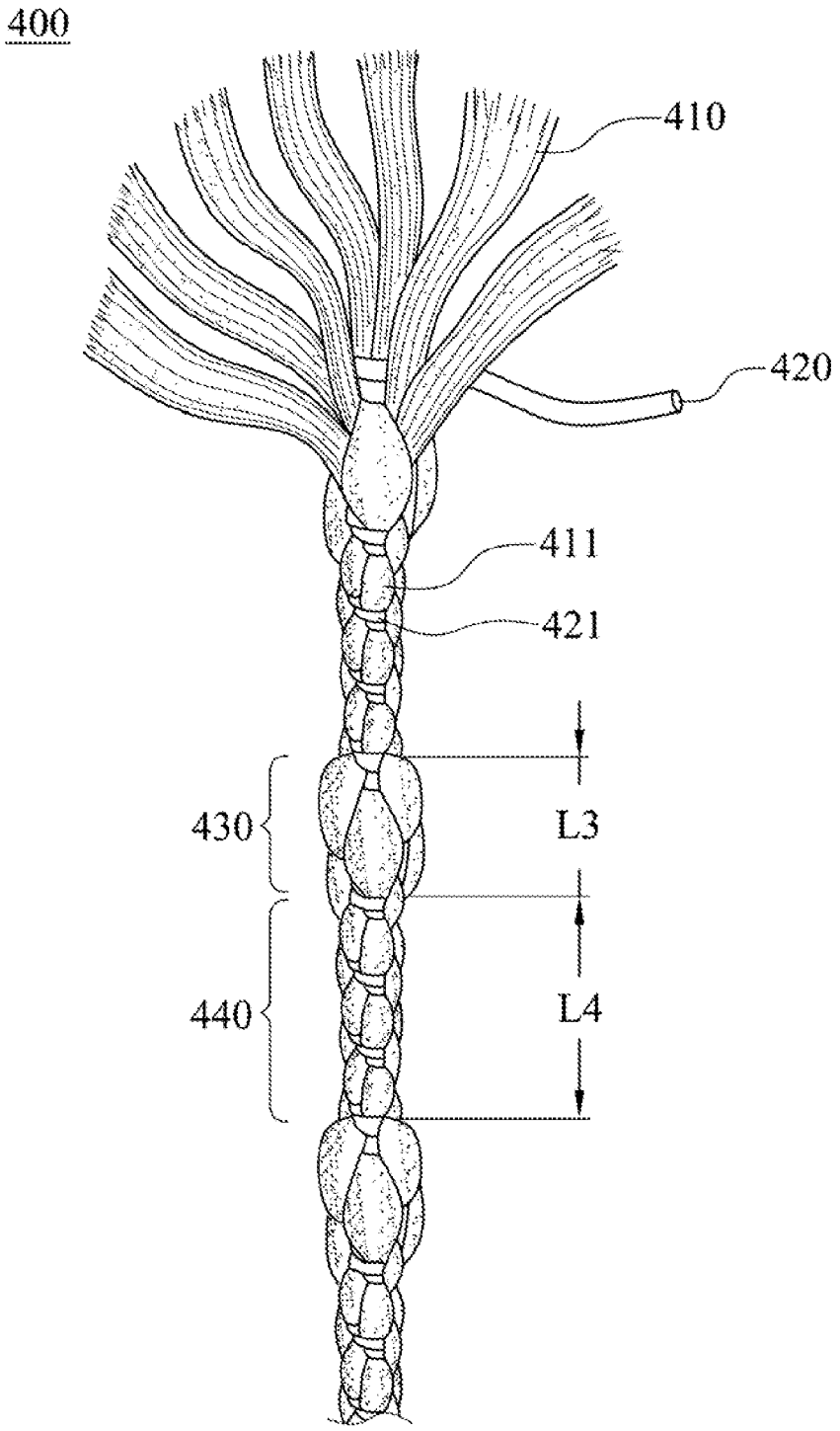
FIG. 4 is a perspective view of a round braid according to the 4th embodiment of the present disclosure.

FIG. 4 is a perspective view of a round braid 400 according to the 4th embodiment of the present disclosure. In FIG. 4, exposing segments 421 of a binding strand 420 and bulging segments 411 of warp strands 410 are disposed staggeredly. Moreover, the round braid 400 has a plurality of large diameter segments 430 and a plurality of narrow neck segments 440, wherein the large diameter segments 430 and the narrow neck segments 440 are disposed staggeredly along an extending direction of the warp strands 410. A length L3 of the large diameter segment 430 is shorter than a length L4 of the narrow neck segments 440. Therefore, a further anti-slip function of the round braid 400 is provided.

As shown in FIG. 3 and in FIG. 4, the arrangement of large diameter segments and narrow neck segments of a round braid according to the present disclosure can be adjusted for providing a desired anti-slip function and increasing the aesthetic value.

Figure 5:
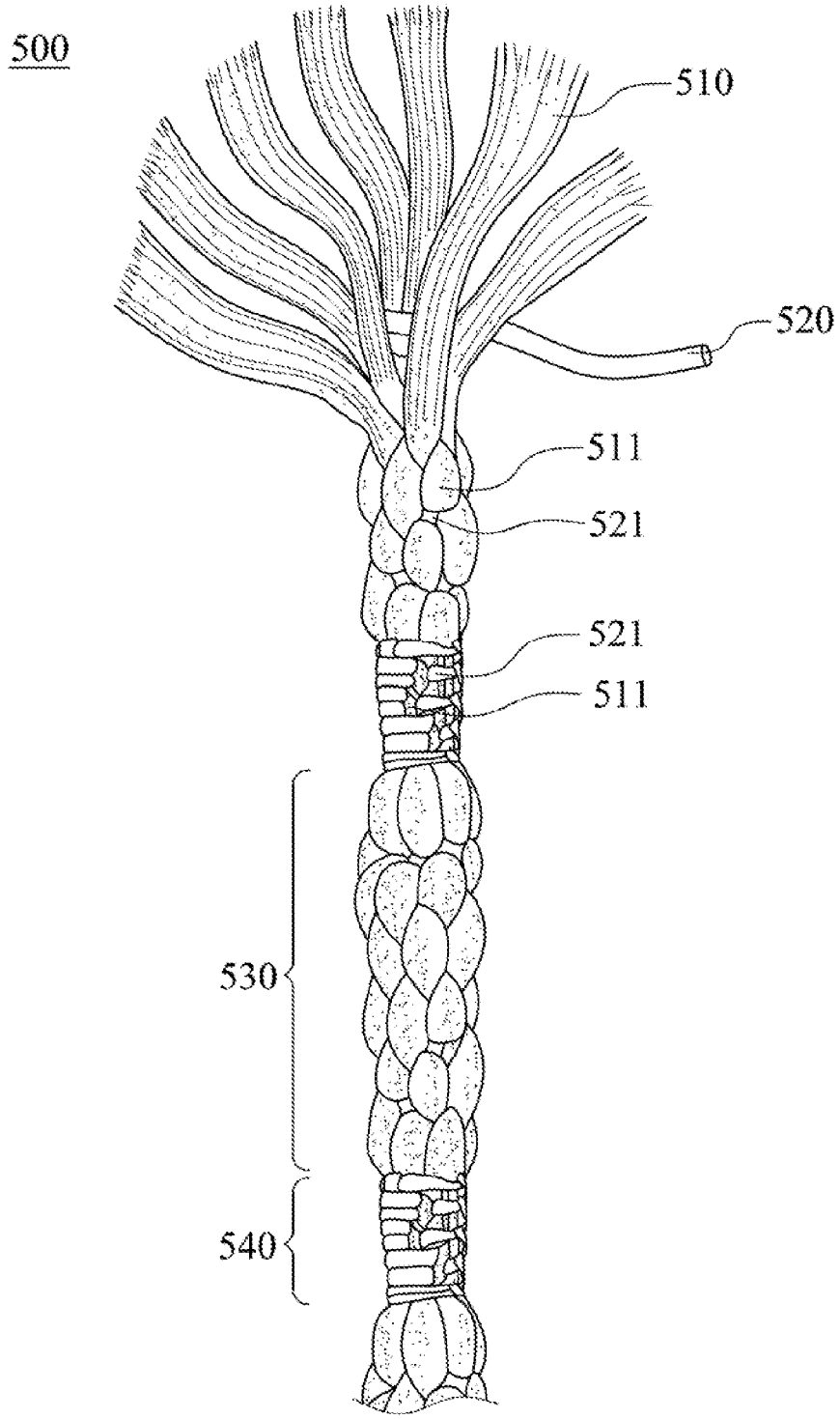
FIG. 5 is a perspective view of a round braid according to the 5th embodiment of the present disclosure.

FIG. 5 is a perspective view of a round braid 500 according to the 5th embodiment of the present disclosure. In FIG. 5, exposing segments 521 of a binding strand 520 and bulging segments 511 of warp strands 510 are disposed staggeredly. Moreover, the round braid 500 has a plurality of large diameter segments 530 and a plurality of narrow neck segments 540, wherein the large diameter segments 530 and the narrow neck segments 540 are disposed staggeredly along an extending direction of the warp strands 510. In the embodiment, a number of the exposing segments 521 of the binding strand 520 changes along the extending direction of the warp strands 510.

Figure 6:
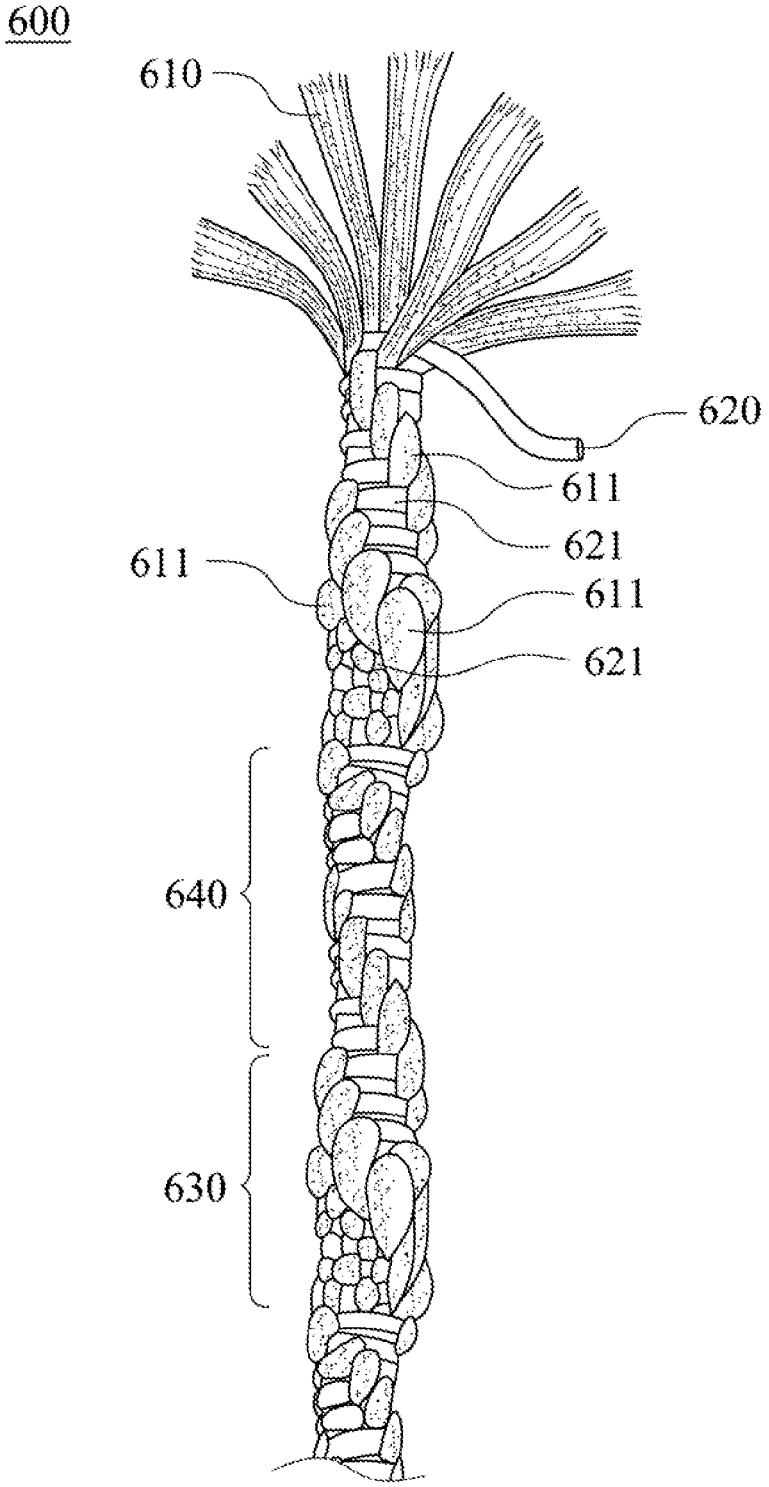
FIG. 6 is a perspective view of a round braid according to the 6th embodiment of the present disclosure.

FIG. 6 is a perspective view of a round braid 600 according to the 6th embodiment of one aspect of the present disclosure. In FIG. 6, exposing segments 621 of a binding strand 620 and bulging segments 611 of warp strands 610 are disposed staggeredly. The round braid 600 is formed in a spiral shape. Specifically, the bulging segments 611 of warp strands 610 are arranged in a spiral path. Furthermore, the round braid 600 has a plurality of large diameter segments 630 and a plurality of narrow neck segments 640, wherein the large diameter segments 630 and the narrow neck segments 640 are disposed staggeredly along an extending direction of the warp strands 610. In the embodiment, a number of the exposing segments 621 of the binding strand 620 changes along the extending direction of the warp strands 610.

According the embodiments disclosed above, a round braid according to the present disclosure has advantages as follows. First, an outer surface of the round braid is rugged, so that a desired anti-slip function and a desired fixed effect are provided. Second, the manufacturing process of the round braid is simple, unlike that of the conventional round shoelace. As mentioned above, the manufacturing process of the conventional round shoelace includes at least three steps, while the round braid needs only to bind the warp strand with the binding strand. Third the material of the thread of binding strand can be the same as that of the threads of the warp strands, so that only one production line is needed for producing the threads. Consequently, the manufacturing process is simplified, and the production efficiency is enhanced. Fourth, the way which the binding strand binds the warp strands can be changed flexibly, so that the arrangement of the exposing segments and the bulging segments can be changed accordingly. That is, the rugged degree of the outer surface of the round braid can be adjusted. On the other hand, the aesthetic value can be enhanced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A round braid, comprising:

a plurality of warp strands, wherein each of the warp strands has at least one thread; and a binding strand having at least one thread, wherein the binding strand binds a part of the warp strands along an extending direction of the warp strands so as to form a plurality of exposing segments and a plurality of bulging segments on an outer surface of the round braid, the exposing segments are exposing parts of the binding strand, the bulging segments are uncovered parts of the warp strands, and the exposing segments and the bulging segments are disposed staggeredly;

wherein the round braid has a plurality of large diameter segments and a plurality of narrow neck segments, and the large diameter segments and the narrow neck segments are disposed staggeredly along the extending direction of the warp strands.

2. The round braid of claim 1, wherein:

the exposing segments of the binding strand change locations thereof along the extending direction of the warp strands.

3. The round braid of claim 1, wherein:

the exposing segments of the binding strand change a number thereof along the extending direction of the warp strands.

4. The round braid of claim 1, wherein:

the thread of the binding strand is made of a material the same as that of the thread of the warp strands.

5. The round braid of claim 1, herein:

the round braid is formed in a spiral shape.

6. A manufacturing method of a round braid, comprising:

providing a plurality of warp strands, wherein each of the warp strands has at least one thread;

providing a binding strand having at least one thread; and binding the warp strands, wherein the binding strand binds a part of the warp strands along an extending direction of the warp strands so as to form a plurality of exposing segments and a plurality of bulging segments on an outer surface of the round braid the ex posing segments are exposing parts of the binding strand, the bulging segments are uncovered parts of the warp strands, and the exposing segments and the bulging segments are disposed staggeredly;

wherein in the step of binding the warp strands the binding strand forms a plurality of weft-wise loops along the extending direction of the warp strands so as to bind the part of the warp strands using the weft-wise loops, and the weft-wise loops hook with each other.

* * * * *